United States Patent [19]

Lefevre

[11] 4,312,720

[45] * Jan. 26, 1982

[54] ELECTROLYTIC CELL AND PROCESS FOR ELECTROLYTIC OXIDATION

[75] Inventor: Joseph D. Lefevre, Bay City, Mich.

[73] Assignee: The Dow Chemical Co., Midland, Mich.

[ * ] Notice: The portion of the term of this patent subsequent to Jul. 22, 1997, has been disclaimed.

[21] Appl. No.: 145,904

[22] Filed: May 2, 1980

Related U.S. Application Data

[63] Continuation-in-part of Ser. No. 939,602, Sep. 5, 1978, Pat. No. 4,213,833.

[51] Int. Cl.[3] ..... C25B 1/34; C25B 9/04; C25B 9/00

[52] U.S. Cl. ..... 204/78; 204/98; 204/128; 204/265; 204/266

[58] Field of Search ..... 204/98, 128, 258, 78, 204/265, 266

[56] References Cited

U.S. PATENT DOCUMENTS

| | | | |
|---|---|---|---|
| 2,890,157 | 6/1959 | Rhetzsch | 204/258 |
| 4,035,254 | 7/1977 | Gritzner | 204/128 |
| 4,169,775 | 10/1979 | Kuo | 204/98 |
| 4,213,833 | 7/1980 | LeFevre | 204/58 |

*Primary Examiner*—R. L. Andrews
*Attorney, Agent, or Firm*—James H. Dickerson, Jr.

[57] ABSTRACT

An electrolytic cell and a method of operating an electrolytic cell having an electrically conductive, foraminous separator support element which is maintained at a voltage potential sufficient to minimize the occurrence of substantial amounts of anodic reactions and cathodic reactions, thereby minimizing corrosion and bipolar effects at the support element.

16 Claims, 2 Drawing Figures

ELECTROLYTIC CELL AND PROCESS FOR ELECTROLYTIC OXIDATION

BACKGROUND OF THE INVENTION

This is a continuation-in-part of copending application Ser. No. 939,602, filed Sept. 5, 1978, now U.S. Pat. No. 4,213,833.

The present invention pertains to and resides in the general field of electrochemistry and is more particularly applicable to an improved supported separator for usage in electrolytic cells.

The production of halogens from aqueous solutions (or other dispersions including even slurries) of their corresponding acids or alkali metal salts and the like by electrolysis thereof in electrolytic diaphragm or equivalent separator cells is well known and widely practiced. Improved techniques to accomplish such production include utilization of oxidizing gas depolarized cathodes in the involved halogen-manufacturing cell units. The manufacture of caustic soda and chlorine from common salt is a good illustration and a particularly important application of this type means for making halogens and associated co-products.

Various aspects relevant to the use of oxygen or oxygen depolarized cathodes in electrolytic cells are amply demonstrated in, inter alia, U.S. Patents and Patent Reference Nos. 1,474,594; 2,273,795; 2,681,884; 3,035,998; 3,117,034; 3,117,066; 3,262,868; 3,276,911; 3,316,167; 3,507,701; 3,544,378; 3,645,796; 3,660,255; 3,711,388; 3,767,542; 3,923,628; 3,926,769; 3,935,027; 3,959,112; 4,035,254; and 4,035,255, all herein incorporated by reference.

It has been observed, however, that in order to employ an oxygen or the like electrode as a depolarized cathode in a chlor-alkali or equivalent diaphragm or equivalent separator cell, it is advantageous for the separator element to be maintained and supported for operation so as to actually be spaced a short distance from the cathode in order to better accommodate gas transport to the cathode while maintaining the electrolyte solution on one side of the cathode and the gas on the other side. This is the case with asbestos diaphragms, ion exchange membranes or anything similar or analogous thereto. It is especially so when a drawn asbestos diaphragm is to be used which, for practical purposes, is better deployed when mounted on a rigid support. While metallic screens, grids or the like foraminous metal constructions are ostentatiously well suited for utilization as support elements or backing members for asbestos diaphragms, they are ordinarily not employed for the purpose. This is because of the disadvantageous fact that under normal operating conditions of a typical electrolytic diaphragm cell, a metallic diaphragm support element frequently and sometimes unpredictably tends, with most undesirable and unwanted results, to become and function as an electrode due to bipolar effects which arise and materially influence metallic support behavior.

The basic characteristics and operational principles and limitations of electrolytic diaphragm and ion exchange membrane cell practice are so widely comprehended by those skilled in the art that further elucidation thereof and elaboration thereon is unnecessary for thorough understanding and recognition of the advance contributed and made possible to achieve by and with the development(s) of the present invention.

SUMMARY OF THE INVENTION

The invention involves an electrolytic cell and a method of operating an electrolytic cell having an electrically conductive, foraminous separator support element which is maintained at a voltage potential sufficient to minimize the occurrence of substantial amounts of anodic reactions, yet insufficient to cause the occurrence of substantial amounts of cathodic reactions, thereby minimizing corrosion and bipolar effects at the support element.

Optionally, a separate means may be used to impose a voltage potential upon the support element or the support element may be electrically connected to the cathode.

The support element may, optionally, be used in electrolytic cells which have either conventional cathodes or oxygen depolarized cathodes.

Optionally, the support element may be less catalytically active than the cathode.

DETAILED DESCRIPTION OF THE DRAWING

Figure 1:
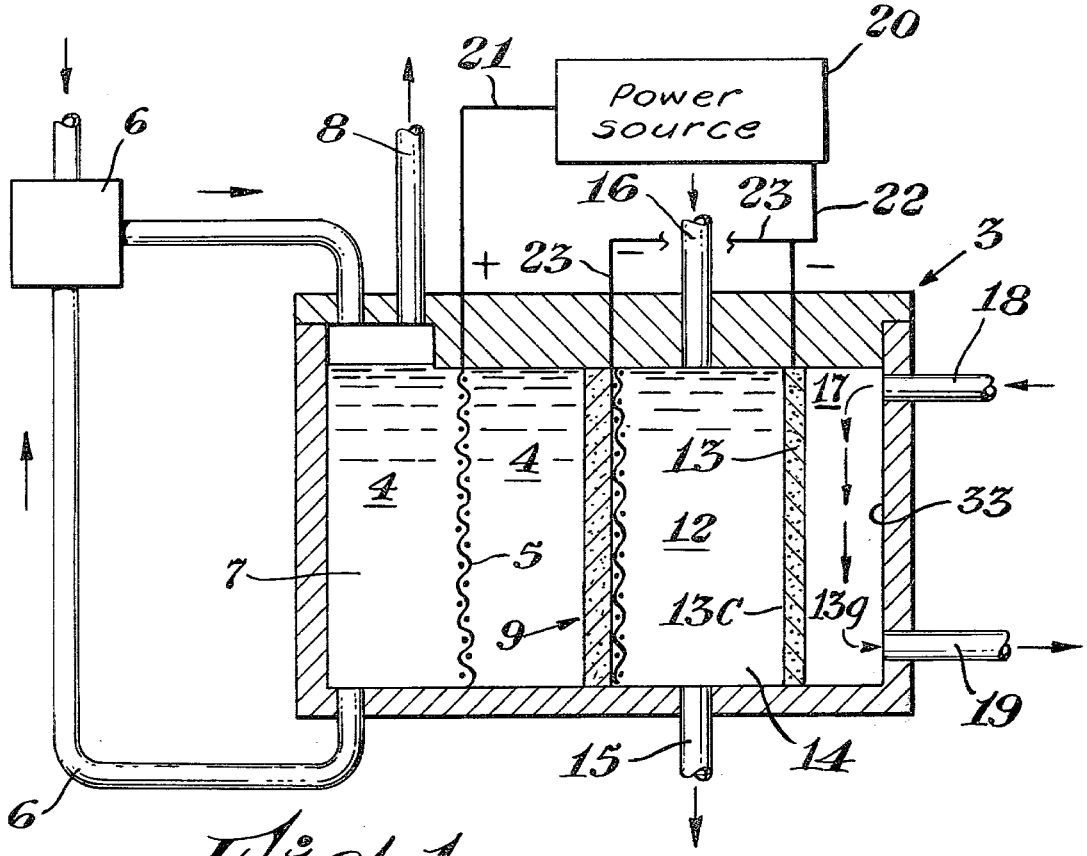
FIG. 1 is a schematic, largely-simplified exaggerated elevational view, mostly in section, of a typical cell utilizing an asbestos-type diaphragm separator placed upon a non-bipolarizing support element pursuant to the invention.

In electrolytic cells which have ion exchange membranes and diaphragms as separators, it is often convenient or sometimes necessary to provide a support for the membrane or diaphragm. Frequently this support is also one of the electrodes of the cell. In certain cases, however, it is preferable to use a separate support for the membrane of diaphragm, especially if it is desirable to maintain a liquid filled section of the cell between the separator and the electrodes.

A convenient support to use, because of strength, availability, and ease of fabrication into a cell, is a foraminous metallic element. However, when such supports are used, bipolar effects may occur, which cause the element to act as an anode or a cathode, and thus allow reactions to take place on the support, which are not desirable. Such reactions include the corrosion of the support element. If, however, the support element is maintained at a voltage potential sufficient to minimize the occurrence of anodic reactions at the element, yet insufficient to cause cathodic reactions to occur at the element, bipolar effects and corrosion problems are minimized.

There are several different physical approaches to accomplishing this, which actually are all related in terms of relative reaction rates on the support element and the electrode. For simplicity, we will assume there is a cathode and a support element on the cathode side of the separator. It will be apparent to one skilled in the art how to apply these techniques to the other possible cases.

In theory, for any electrochemical reaction, on equilibrium potential can be calculated from thermodynamic considerations. However, for this reaction to proceed at a finite rate (i.e. net current flow in a cell) a voltage in excess of this equilibrium value must be applied to the cell. This "extra" voltage is known as overvoltage, and is the result of three main factors:

(a) the energy required for electron transfer, which varies with the compound to be reacted, and with the nature of the electrode. This is known as activation or reaction overvoltage.

(b) the potential loss which occurs whenever a current passes through a resistor. This is commonly known as IR loss.

(c) the changing concentrations of the active species at the electrode-solution interface. Note that this contribution (concentration overvoltage) follows from the Nernst equation, i.e., as the concentration of active species at the electrode surface changes due to reaction, the equilibrium potential changes. Thus, concentration overvoltage exists only because the concentration reference point for which the equilibrium potential is calculated (or measured, at zero current flow) is the bulk solution, rather than the actual concentration (strictly activity) of the reacting species at the electrode surface.

Consider now the combination of support element and a electrode that can be used.

One possible combination would be an electrode that is fabricated in such a way (material, structure, etc) that the same reaction cannot take place to any great extent on the support element. Such a combination could be, for example, a porous gas diffusion electrode and a steel screen. The porous electrode could allow the oxygen reduction reaction to proceed at a useful rate, at a low overvoltage, whereas this reaction does not proceed to any useful extent on steel at normal cell operating conditions. Thus, by connecting the support element to the electrode via an electrical conductor, or by applying a control voltage to the support via a separate power supply, the voltage of the support element is held near that of the electrode. Since in the case cited here the voltage at which the electrode is operating is not sufficient to cause a reaction to occur at the support element, the element remains electrochemically inactive, but protected against corrosion since it is being held at a cathodic potential.

If a gas electrode is used, the material of the support element does not have to be dissimilar, although for economic reasons it will usually be desirable to use a less expensive material than the electrode. A gas diffusion electrode requires a region of the three phase (gas, liquid, solid) contact for successful operation, especially in order to maximize the rate of gas transfer to the reacting sites on the electrode. Assuming the support element is liquid-covered, as it would be under normal cell operating conditions, then the rate of gas transfer is so slow (i.e. the concentration overvoltage would become so high) that virtually no reaction takes place on the support element when it is held at a voltage near that of the electrode.

The use of different electrode materials which have different activation overvoltages for the same reaction can be used without resorting to special (e.g. gas diffusion) electrodes. The activation overvoltage for $H_2$ evolution is very much greater on lead than on platinum. Thus, for a given potential applied to a lead support and a platinum electrode, the current density on the platinum will be very much higher. By choice of current density, the rate of $H_2$ evolution on the support is minimized.

It is also possible to reduce the rate of reaction on the support element by making an electrode with a very much larger surface area. Since the overvoltage is also affected by current density, a large surface area with a low true surface area current density will operate at a low overvoltage. A low overvoltage will not sustain much reaction on a low surface area support.

With initial reference to FIG. 1 of the Drawing, there is shown an electrolytic cell, identified generally by the reference numeral 3, for the production of a halogen (such as chlorine) from a corresponding acid (such as hydrogen chloride) or alkali metal chloride (such as sodium chloride) or even in many situations where economically affordable for production of other end products from diverse acids and salts as from sulfates, nitrates and so forth. For purposes of immediate illustration, the cell 3 is pictured to be electrolyzing sodium chloride brine into chlorine and sodium hydroxide and to be provided with an asbestos diaphragm separator.

The cell 3 includes an anode compartment 4 with an anode 5, at which the oxidation reaction occurs, positioned therein. This is in spaced juxtaposition with a cathode compartment 12 having therein positioned a depolarized cathode 13, at which the reduction reaction substantially occurs. A separator supported by a non-bipolarizable support element identified generally by reference numeral 9, is positioned in the cell to divide or separate anode compartment 4 from cathode compartment 12. The separator and its support element 9 is adapted to pass sodium ions from the anolyte solution 7 in anode compartment 4 to the catholyte solution 14 in cathode compartment 12. This is accomplished, for reasons and by means as above mentioned and hereinafter more fully explained, with the support element maintained at a voltage potential sufficient to minimize the occurrence of substantial amounts of anodic reactions, yet insufficient to cause the occurrence of substantial amounts of cathodic reaction. The support element, accordingly, is able to at least substantially, if not completely, withstand electrolysis system influences that tend to place it in an undesirable bipolarized condition.

Typically, cell 3 further includes a source of sodium chloride brine (not shown) and a means 6 to feed the brine into the anode compartment 4 and maintain the anolyte 7 at a predetermined and suitably operable sodium chloride concentration, as desired. Gaseous chlorine is removed from anode compartment 4 by any suitable means, such as conduit 8, which is connected in an appropriate venting communication with the compartment in order to safely and efficiently afford the desired withdrawal and recovery of the halogen product.

The cathode may be a conventional cathode (not shown) or an oxygen depolarized cathode 13. The depolarized cathode 13 may be spaced apart from a side portion or wall 33 of the cell 3 to form an intermediate opening or gas compartment 17. An oxidizing gas, such as air, oxygen-enriched air, oxygen, ozone (or the like or equivalent) is forced through inlet tube 18 into, preferably, the upper portion of the compartment 17 and passed into intimate contact with an outer surface or face **13*g* of the cathode 13. The oxidizing gas, following the flow pattern through compartment 17 depicted by the directional arrows therein, is then withdrawn through outlet means 19 for disposal or recycle, depending upon the practice most expedient and preferred under the particular operating conditions being followed. Cathode 13, pursuant to known practice for cathodes depolarized with an optionally moisturized oxygen-bearing gas, is composed of a suitable material adapted to transmit or pass, with minimized or no bubble formation on egress, the given oxidizing gas from compartment 17 to an inner portion or surface 13c** of the cathode.

Thus, cathode 13 is preferably an embodied foraminous construction having at least the surface thereof composed of a material that is substantially inert and resistant to the corrosive effects of the catholyte such as, for example (but not limited to), gold, iridium, nickel, osmium, palladium, platinum, rhodium, ruthenium and silver (or compositions and platings thereof including, as an illustration, a suitable foraminous copper substrate that is silver plated) with an applied and integral coating thereover of a mixture of the particulate metallic constituent and an inert binder therefor such as polytetrafluoroethylene, polyhexafluoropropylene and other polyhalogenated ethylene or propylene derivatives such as fluorinated copolymers of hexafluoropropylene and tetrafluoroethylene, which coating mixture may advantageously contain between about 30 and about 70 weight percent carbon black with a mesh size of less than about 300 admixed with up to say, 10 or so weight percent of carbon fibers.

These metallic materials, as is known, have a beneficial catalytic effect for reaction under the conditions of electrolysis in the presence of water of the $O_2$ in the oxygen-bearing gas at the surface of the depolarized cathode.

The inert material may be any one of the substances known as carbon black, nickel black, nickel oxide black, platinum black, or silver black. The particulate material that is ordinarily designated as a "black" advantageously has a range of less than about 300 in the U.S. Standard mesh size series.

The actual base construction of the metal in the cathode may, for example, be in the form of a screen or an expanded metal section or an apertured or perforated sheet of equivalent grid-like structure having a thickness in the neighborhood of from about 10 to about 100 mils (ca. 0.254 and 2.54 millimeters) and a porosity or total hole or open area which is between about 20 and about 40 percent of the total area of that portion of the grid having the greatest exposed surface with the mean diameter (or equivalent measure of the openings each being between about 15 and about 30 mils—or ca. 0.381 and 0.762 millimeter). Plated layers, such as of silver on copper or a copper alloy, is desirably substantially if not completely continuous and in a thickness of about 2 mils (ca. 500+ microns).

The cathode 13 may be made up as a screen construction which is either entirely woven from or, alternatively, partially fabricated of and subsequently adherently plated or coated with metallic gold, platinum, nickel, or silver with a mesh size of from about 30 to about 60 or, preferably, about 50.

Nickel is frequently a preferred choice as the material of screen construction. Although usually not employed for depolarized cathodes, it is also possible to use a mild steel or other ferrous material or alloy including stainless steels for the grid-like cathode structure, especially when it is appropriately coated or plated with a suitable catalyzing substance of the sort above described.

The anode construction may be analogous to that employed for the cathode, excepting that for brine electrolysis, it generally is not comprised of any ferrous materials. It can also be a carbon or graphite electrode body or, oftentimes with advantage, a structure of the type known in the art as a dimensionally stable anode comprised of base members of, for example, tantalum or titanium and tungsten or zirconium, or other electroconductive materials coated or plated with such metals, for example, as at least one metal or oxide of the platinum group metals or iridium, rhodium, ruthenium and so forth including other of the elements above-identified for constituting the inert anode surface.

Optionally, a circulating means (such as agitators, impellers, recirculatory pump installations, aerators or gas bubblers, ultrasonic vibrators and so forth, not shown) to continuously move the catholyte 14 and avoid stagnations thereof within the cathode compartment 12, primarily to promote thorough mixing of the catholyte formulation may be used. The rate of such catholyte movement should be sufficient to ensure adequate repetitive and nearly, if not completely, total liquid contact of the cathode interface and yet not so intense as to cause any physical injury to or disruption of the diaphragm element 9 or equivalent separator element.

During cell operation, the catholyte 14 becomes increasingly enriched in its concentration of sodium hydroxide. This co-product can be removed in regulated fashion to keep catalytic caustic content at a controlled, predetermined strength.

The electrical energy necessary to conduct the electrolysis in cell 3 is obtained from a power source 20 connected to energy transmission or carrying means such as aluminum (especially in corrosion-resisting adaptations), magnesium-filled titanium or copper conduits, bus bars or cables 21 and 22 to respectively provide direct electrical current to the anode 5 and cathode 13.

Figure 2:
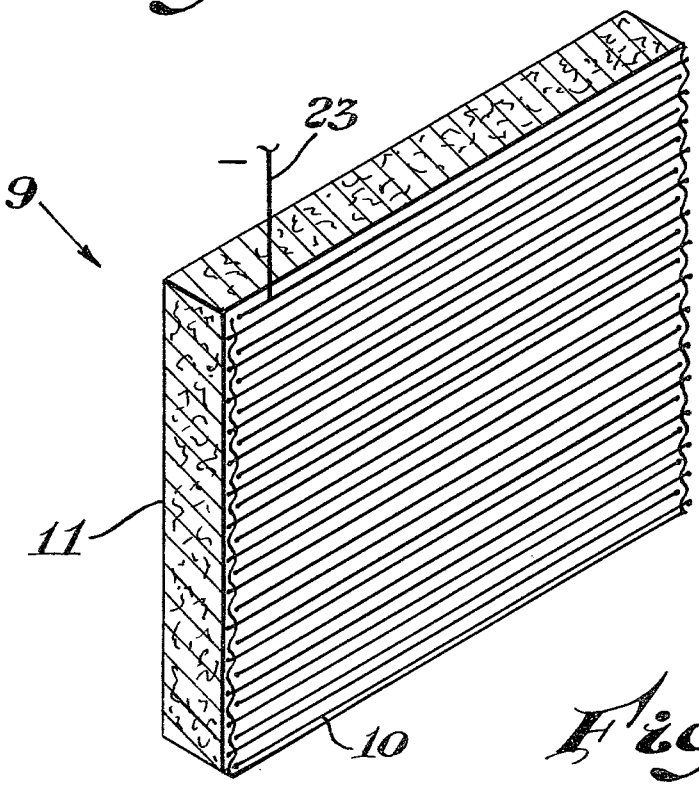
FIG. 2 is a view in fanciful, enlarged, cross-sectional perspective of one embodiment of the separator support element having an asbestos-type diaphragm imbedded therein.

FIG. 2 shows an asbestos-type diaphragm 11 supported by a support element 10. Support element 10 is an electrically conductive foraminous element. It should be resistant to chemical attack by the catholyte. It is possible to satisfactorily employ even a mild steel screen support for the diaphragm element. The support may even be used in acid systems so long as the support is on the cathode side of the membrane or separator, thus being exposed to alkaline conditions.

The respective applied voltages on the support element 10 and the cathode may be different so long as they are of values more negative than that on the anode. The voltage differences that are permissible between support element and cathode are difficult to generalize for all possible applications since suitable ranges may vary between given electrolytic systems. However, the voltage applied on the support element is obviously of some intermediate value between those applied on and across the anode and cathode. The support element voltage must be sufficiently negative with respect to anode voltage (taking into account the relative negative potential at which the cathode is operated) to provide effective cathodic protection in the system for the support member of the separator element, especially when the support is metallic while, at the same time, not being so electrically positive with respect to cathode potential as to cause hydrogen formation or evolution at the separator.

Practice of the present invention makes the support element at least substantially if not completely inactive with respect to the anode and free from objectionable bipolarization tendencies due to the nature of operation of the oxidizing gas depolarized cathode and the electrical potential at which it operates.

A bipolar effect, as it is believed to be encountered, results, according to one theory, from the energetics involved in electrolytic cell operation when an extra electricity-conducting barrier is independently placed between the anode and cathode therein, such as the support screen in and for separator element 9 when it is not connected to the cathode. The screen then in effect becomes and serves as an extra electrode. In such a situation whenever enough voltage is applied to the cell or electrically induced by the voltage drop involved, the intermediate electrically disconnected barrier will commence to operate on its anolyte side as a cathode and on its catholyte side as an anode with concurrent flow of ions across the barrier to allow such operation. This, of course, is intolerable. It is the unwanted and highly detrimental effect so nicely minimized or circumvented by practice of the invention.

The support element 10 can be sized somewhat similarly to the screens used for cathode construction, excepting that networks having relatively larger openings can be employed. In any event, the support element has openings large enough to accommodate free flow of materials through the diaphragm or ion-exchange membrane separator element yet small enough for effective support of the applied diaphragm material. Thus, the networks used may have openings that are as big as $\frac{1}{4}\times\frac{1}{4}$ inch (0.6×0.6 or so, centimeter) or, if desired, even as large and $\frac{1}{2}\times\frac{1}{2}$ inch (1.3×1.3, or so, centimeters).

Although asbestos, per se, is frequently used as the porous diaphragm material of the supported layer 11 when an asbestos-type diaphragm separator is used, many other equivalent materials can be adapted for such purpose including, for example, mixtures of asbestos and fibrous polytetrafluoroethylene (e.g., sold under the trade name "Teflon") or fibers or other polymers and copolymers of fluorinated ethylenes, propylenes and the like. Conventional and typically utilized layer thicknesses of the asbestos-type diaphragm material may be placed on the screen to form the diaphragmatic separator element 9. In this connection, and as is appreciated by those skilled in the art, too thick an asbestos or the like layer may be unsatisfactorily impermeable and tend to become too readily plugged and inhibiting of free flow through the separator while layers that are too thin may not hold well on the support or even tend to rupture and give intolerably large openings or holes in the layer.

An efficient and satisfactorily practical way of making an asbestos diaphragm separator element 9 is, for example, to draw or aspirate an at least substantially even layer 11 in desired thickness of the asbestos or asbestos-type separator material onto the supporting screen whereupon the diaphragmatic deposit is formed in place and integrally held upon and by the support screen 10. This may be done in and by a tank arrangement containing the slurry wherein the screen is held in a most suitable position against the slurry and a suction applied from its back side draws the fibrous diaphragm material onto the screen. The element 9, with or without drying, is then ready for employment in a cell. For this use, the diaphragm separator element 9 is disposed with the screen support 10 portion thereof facing the cathode.

Alternatively, if desired, the asbestos or equivalent diaphragm material in the separator may be in the form of a paper-like web or nonwoven mat of the asbestos or other fiber or fiber mixture that is utilized. Such a construction may, as desired, be securely mounted on one or both sides of the electroconductive foraminous support member. Ordinarily, however, a single side application of the separator material is satisfactory. Adhesives, mechanical fasteners or any other desired means may be employed for the mounted diaphragm layer or layers. It is also possible to spray or paint suitable compositions of the asbestos or its equivalent fibrous separator materials on one or both sides of the support member therefor.

As also mentioned, the separator element may be comprised of an ion-exchange membrane mounted securely on one side only or, if desired, on both sides of the foraminous support member. These are of the well-known sort which contain fixed anionic groups that permit intrusion and exchange of cations while excluding anions from an external source. Generally, the resinous membrane or equivalent separator structure has a cross-linked polymer or the like matrix or support construction to or with which are attached or included such negatively charged radicals as: $—SO_3$; $—COO^-$; $—PO_3^{--}$; $—HPO_2^-$; $—AsO_3^{--}$; and $—SeO_3^-$. Vinyl addition polymers and condensation polymers may be utilized for composition of the cation exchange construction, including polymers of such monomers as styrene, divinylbenzene, ethylene and the like aliphatic olefins and monomeric fluorocarbons. Preparation of such resinous materials is described in U.S. Pat. No. 3,282,875. The ion-exchange membranes available under the trade-designation "Nafion" from E. I. du Pont de Nemours and Company, Inc., are well suited for the indicated purpose.

An optional part of the separator element 9 of the present invention is the means for electrically connecting the screen support 10 with the cathode 13. One simple and effective way to do this is by means of connecting the lead or tie line 23 (that can also be a conduit, bus bar or cable of the above-identified materials) which is directly connected to the cathode in any suitable way, such as by interwiring the lead to and through power line 22 running between power source 20 and cathode 13. This, as shown, can be done at or near the point where line 22 is connected to the cathode or at any intermediate point along line 22 from and including its connection directly at the negative side of power source 20 from which line 22 emanates. Alternatively, as noted (but with the additional electrical means not specifically shown in the Drawing), a separate power supply connected directly with separator element 9 through screen support 10 may be utilized to maintain the element at about the same voltage potential as that of the cathode. When this is done, the separate power supply is connected through lead 23 and is regulated so as to be at or about the same voltage as that applied to the cathode through conduit 22.

The following Examples illustrate various embodied practices of the invention.

EXAMPLE 1

An electrolytic cell similar to that shown in FIG. 1 with an anode of titanium coated with an oxide of ruthenium and titanium spaced apart from an oxygen gas depolarized cathode by a du Pont "Nafion 12V6C1" cation exchange membrane is operated to produce chlorine gas at the anode and sodium hydroxide in the cathode compartment. The ion exchange membrane is mounted on a 100 mesh nickel screen and placed between anode and cathode in the cell so as to have the screen facing the cathode. Each electrode has a surface area of 3 square inches (ca. 19.35 square centimeters) and the screen has about the same flat size. The cathode is formed by admixing 7 grams of carbon black with 0.2 gram of carbon fiber, 3.3 milliliters of du Pont Teflon 30B latex and about 20 to 30 milliliters of water to form a dough-like mixture. The mixture is rolled to about 0.05 inch thick and then pressed together with a 40 mesh woven silver screen using a force of about 15 tons. The pressed composite is heated in a nitrogen atmosphere for about 2 to 3 minutes at a temperature of about 350° to 360° C. After cooling in a nitrogen atmosphere, the composite is heated to about 100° to 120° C. and sprayed on a single surface with sufficent "Teflon 30B" latex (diluted one part latex to eight parts water) to form a coating of about 2 to 10 milligrams Teflon latex per square centimeter of surface. The sprayed composite is then heated for about 2 minutes at about 350° 360° C. in a nitrogen atmosphere. The sprayed Teflon latex surface is positioned in the cell to form a wall portion of a depolarizing gas compartment.

In its installation in the cell, the nickel screen is electrically connected directly to the cathode by means of a copper wire lead.

With a low direct current voltage applied across the anode and cathode, an aqueous sodium chloride brine is circulated through the anode compartment, with sodium chloride additions for composition control, and a sodium hydroxide containing catholyte is circulated, with water additions for composition control. Oxygen gas is pumped through the gas compartment at a rate of 66 milliliters per minute after first saturating the oxygen with water. During operation, the anolyte has an acidity (pH) of 5.5 and contains about 260 to 290 grams per liter of sodium chloride. The catholyte contains 79.6 grams per liter of sodium hydroxide and 4.1 grams per liter of sodium chloride. The electrolyte temperature is about 70° C. Operating voltage is 1.901 and the amperage is 1.5.

Cell operation is satisfactory without production of either hydrogen gas in the cathode compartment or observable bipolarization of the separation element during the operation or noticeable corrosion of the screen after prolonged running of the cell.

EXAMPLE 2

In another specific illustration of the invention, an asbestos slurry is drawn to make a deposited layer of about 1/16 inch (ca. 0.16 centimeter) on a 100 mesh nickel screen to form a diaphragm element in accordance with the present invention and in the style shown with more detail in FIG. 2. A 3-square inch section of the supported diaphragm is employed with excellent and entirely satisfactory results for the successful electrolysis of sodium chloride brine in a cell apparatus constituted and run as above shown and described in connection with the Example 1.

After 45 days of continuous operation, the cell is shut down and the diaphragm element removed for inspection. The asbestos diaphragm is stripped off the screen for purposes of screen examination and testing. There is no detectible weight loss in the screen and no discernible signs of corrosion thereon.

The same procedure is repeated excepting for employing a stainless steel screen to support the asbestos diaphragm. The same good results are obtained.

In contrast, and to illustrate practice not in accordance with the invention, when the foregoing is duplicated with a stainless steel screen support excepting to disconnect the wire shorting the screen to the cathode, a substantial formation of iron hydroxide flock is visually discernible in the catholyte after only about 10 days of operation which becomes noticeably heavier after 20 days. This is accompanied within the indicated periods by substantial and readily measurable weight loss of the screen due to corrosion because of operation thereof in a bipolarized condition in the cell.

Analogous good results are obtained when the foregoing second Example is repeated excepting to replace the deposited asbestos layer with an attached "Nafion" membrane section on the nickel screen. The same occurs when repetitions of the procedures are repeated with varied cell operating voltages and charged salt and/or caustic concentrations in anolyte and catholyte.

Many changes and modifications can readily be made and provided in various adaptations and embodiments in accordance with the present invention without substantially departing from the apparent and intended spirit and scope of the same relevant to the instantly contemplated electrolytic cell separator support development and provision. Accordingly, the invention in accordance with same is to be taken and liberally construed as it is set forth and defined in the hereto-appended claims.

What is claimed is:

1. A method of operating an electrolytic cell comprising:

(a) feeding an oxidizable material in an aqueous medium into an anolyte compartment containing an anode;

(b) maintaining a reducible catholyte in a catholyte compartment containing a cathode separated from the anode by a diaphragm or an ion exchange membrane supported by an electrically conductive, foraminous support element;

(c) impressing a direct current electrical potential between the anode and the cathode;

(d) maintaining the support element at a voltage potential sufficient to minimize corrosion of the support element yet insufficient to cause the occurence of substantial amounts of anodic and cathodic reactions.

2. The method of claim 1 wherein the cathode is an oxygen depolarized cathode.

3. The method of claim 2 including feeding an oxygen containing gas to at least one surface portion of the oxygen depolarized cathode.

4. The method of claim 1 wherein the support element has an activation overvoltage for hydrogen greater than the activation overvoltage for hydrogen of the cathode.

5. The method of claim 4 wherein the element is maintained at a voltage potential about the same as that of the cathode.

6. The method of claim 5 wherein the potential of the element is maintained by an electrical connection between the element and the cathode.

7. The method of claim 5 wherein the potential of the element is maintained with a separate power supply.

8. The method of claim 1 wherein the cathode has a larger amount of surface area than does the support element.

9. In an improved electrolytic cell with an anode compartment adapted to contain an anolyte, an anode positioned in said anode compartment; a cathode compartment adapted to contain a catholyte; a cathode positioned in said cathode compartment; an ion exchange membrane or diaphragm spacing apart said anode and said cathode; means for providing electrical current to said anode and said cathode, the improvement comprising:

an electrically conductive foraminous support element for the diaphragm or ion exchange membrane and means for controlling the support element at a voltage potential sufficient to minimize corrosion of the support element yet insufficient to cause the occurrence of substantial amounts of anodic and cathodic reactions at the support element.

10. The improved electrolytic cell of claim 9 wherein the cathode is an oxygen depolarized cathode.

11. The improved electrolytic cell of claim 9 wherein the element includes a metallic screen.

12. The improved electrolytic cell of claim 11 wherein said screen is nickel or an alloy thereof.

13. The improved electrolytic cell of claim 9 wherein the cathode has a larger surface area than does the support element.

14. The improved electrolytic cell of claim 9 wherein the support element has a hydrogen activation overvoltage greater than the hydrogen activation overvoltage of the cathode.

15. The improved electrolytic cell of claims 10 or 6 wherein the potential maintaining means is an electrical connection between the element and the cathode.

16. The improved electrolytic cell of claims 9, 2 or 6 wherein the electrical potential maintaining means is a power supply separate from the means to provide electrical potential to the cathode.

* * * * *

UNITED STATES PATENT AND TRADEMARK OFFICE

CERTIFICATE OF CORRECTION

PATENT NO. : 4,312,720

DATED : Jan. 26, 1982

INVENTOR(S) : Joseph D. Lefevre

It is certified that error appears in the above-identified patent and that said Letters Patent are hereby corrected as shown below:

Col. 2, line 35, delete "and" and insert therefor --or--.

Col. 2, line 40, delete "of" and insert therefor --or--.

Col. 2, line 64, delete "on" and insert therefor --an--.

Col. 3, line 46, delete "the" in front of three.

Col. 5, line 38, delete "of" and insert therefor --or--.

Col. 6, line 2, delete "and" and insert therefor --or--.

Col. 7, line 36, delete "or" second occurrence and insert --of--.

UNITED STATES PATENT AND TRADEMARK OFFICE

CERTIFICATE OF CORRECTION

PATENT NO. : 4,312,720

DATED : Jan. 26, 1982

INVENTOR(S) : Joseph D. Lefevre

It is certified that error appears in the above—identified patent and that said Letters Patent is hereby corrected as shown below:

Col. 9, line 14, delete "sufficent" and insert therefor --sufficient--.

Col. 9, line 18, after 350° insert --to--.

Col. 10, line 21, delete "the" in front of same.

Col. 10, Claim 1(d), line 41, delete "occurence" and insert therefor --occurrence--.

Signed and Sealed this

*Fourth* Day of *May 1982*

[SEAL]

*Attest:*

GERALD J. MOSSINGHOFF

*Attesting Officer* *Commissioner of Patents and Trademarks*